US006055695A

United States Patent [19]

McKay, Jr.

[11] Patent Number: 6,055,695

[45] Date of Patent: May 2, 2000

[54] LINT ROLLER ASSEMBLY

[75] Inventor: Nicholas D. McKay, Jr., Birmingham, Mich.

[73] Assignee: Helmac Products Corporation, Flint, Mich.

[21] Appl. No.: 09/104,605

[22] Filed: Jun. 24, 1998

[51] Int. Cl.[7] ..... A47L 25/00

[52] U.S. Cl. ..... 15/104.002; 15/230.11; 492/13

[58] Field of Search ..... 15/104.002, 230.11; 492/13, 14, 19

[56] References Cited

U.S. PATENT DOCUMENTS

| | | | |
|---|---|---|---|
| 3,156,938 | 11/1964 | Bills | 15/104.002 |
| 3,201,815 | 8/1965 | Selby | 15/104.002 |
| 3,386,124 | 6/1968 | Feine | 15/230.11 |
| 4,361,923 | 12/1982 | McKay | 15/104.002 |
| 4,422,201 | 12/1983 | McKay | 15/104.002 |
| 4,557,011 | 12/1985 | Sartori | 15/104.002 |
| 4,570,280 | 2/1986 | Roth | 15/104.002 |

*Primary Examiner*—Mark Spisich

*Attorney, Agent, or Firm*—Gifford, Krass, Groh, Sprinkle, Anderson & Citkowski, P.C.

[57] ABSTRACT

A lint roller assembly is disclosed for rotatably supporting a tubular and cylindrical adhesive lint remover roller. The assembly includes a pair of elongated housing parts which are substantially identical to each other. Each housing part includes an elongated handle section and a semi-cylindrical lint roller support section longitudinally adjacent the handle section. The lint roller support section has an outer diameter less than the diameter of the adhesive roller. The housing parts are secured together in a facing relationship by registering pins and sockets formed on the housing parts. In doing so, the lint roller support sections form a cylindrical lint roller support for the adhesive roller while the handle sections abut against each other to form a handle.

11 Claims, 3 Drawing Sheets

20
10
16
17
12
12
12
12
15
14

LINT ROLLER ASSEMBLY

BACKGROUND OF THE INVENTION

1. Field of the Invention

The present invention relates to a lint roller assembly.

2. Description of the Prior

There are many previously known lint roller assemblies. These previously known lint roller assemblies typically comprise a handle secured to a cylindrical lint roller support. A tubular cylindrical adhesive lint roller is then removably mounted to the support such that the adhesive roller is rotatable relative to the handle. In use, the adhesive lint roller is rolled along a user's clothes to remove lint, hair and other debris.

The previously known lint roller assemblies have used a number of different means to rotatably mount the lint roller support to the handle. For example, in U.S. Pat. No. 4,361,923 to McKay, the lint roller support and handle are separately constructed and then rotatably secured together. One disadvantage of this type of previously known lint roller assembly, however, is that the rotatable connection between the handle and lint roller support is subjected to mechanical wear and tear and, ultimately, mechanical failure.

A still further disadvantage of this type of previously known lint roller assembly is that both the handle and the lint roller support were separately molded from plastic and then assembled together. As such, two different molding cavities were required for each lint roller assembly, i.e. one cavity for the lint roller support and a second cavity for the handle.

Still other types of previously known lint roller assemblies such as that disclosed in U.S. Pat. No. 4,5577,011 to Sartori, utilize a unitary lint roller handle and lint roller support. These previously known lint roller assemblies, however, require a complex and, therefore, expensive mold design in order to mold the lint roller handle and support. Furthermore, a relatively large frictional engagement between the lint roller and the lint roller support oftentimes interfered with the desired free rotation of the lint roller about the lint roller support.

SUMMARY OF THE PRESENT INVENTION

The present invention provides a lint roller assembly which overcomes all of the above-mentioned disadvantages of the previously known devices.

In brief, the lint roller assembly of the present invention comprises a pair of elongated housing parts, each of which is substantially identical to each other. Each housing part includes an elongated handle section and a semi-cylindrical lint roller support section longitudinally adjacent the handle section.

In order to form the lint roller assembly, the housing parts are secured together in a facing relationship such that the semi-cylindrical lint roller support sections together form a cylindrical lint roller support having an outside diameter less than the inside diameter of the adhesive lint roller. Similarly, the handle sections also abut together to form the completed handle.

Any conventional means can be utilized to secure the housing parts together. However, in the preferred embodiment of the invention, each housing part has a plurality of pins and recesses formed on opposite sides of and equidistantly spaced from a longitudinal center line of the housing part. Each pin is laterally aligned with one recess which is dimensioned to receive and frictionally engage its corresponding pin to thereby frictionally secure the housing parts together. Optionally, an adhesive can be utilized between the housing pins and recesses.

In order to rotatably mount the tubular cylindrical adhesive lint roller to the lint roller support, a plurality of circumferentially spaced and radially outwardly extending flexible fingers are formed at the end of the lint roller support sections opposite from the handle. These flexible fingers have an outside diameter greater than the inside diameter of the lint roller such that, with the lint roller inserted over the lint roller support, the flexible fingers extend outwardly along one end of the lint roller thus entrapping the lint roller to the lint roller support. The fingers, however, are sufficiently flexible such that they flex inwardly to permit the installation of the roller onto the roller support.

In order to minimize the frictional contact between the lint roller support and the adhesive lint roller, a plurality of circumferentially spaced and longitudinally extending ribs are formed along the outer periphery of the lint roller support. Since only the outer periphery of the ribs contact the inner periphery of the lint roller, only a minimal frictional contact between the interior of the lint roller and the outer periphery of the lint roller support occurs thus facilitating free rotation of the lint roller about its support. These ribs also mechanically strengthen the lint roller support.

BRIEF DESCRIPTION OF THE DRAWING

A better understanding of the present invention will be had upon reference to the following detailed description when read in conjunction with the accompanying drawings, wherein like reference characters refer to like parts throughout the several views, and in which.

DETAILED DESCRIPTION OF A PREFERRED EMBODIMENT OF THE PRESENT INVENTION

Figure 1:
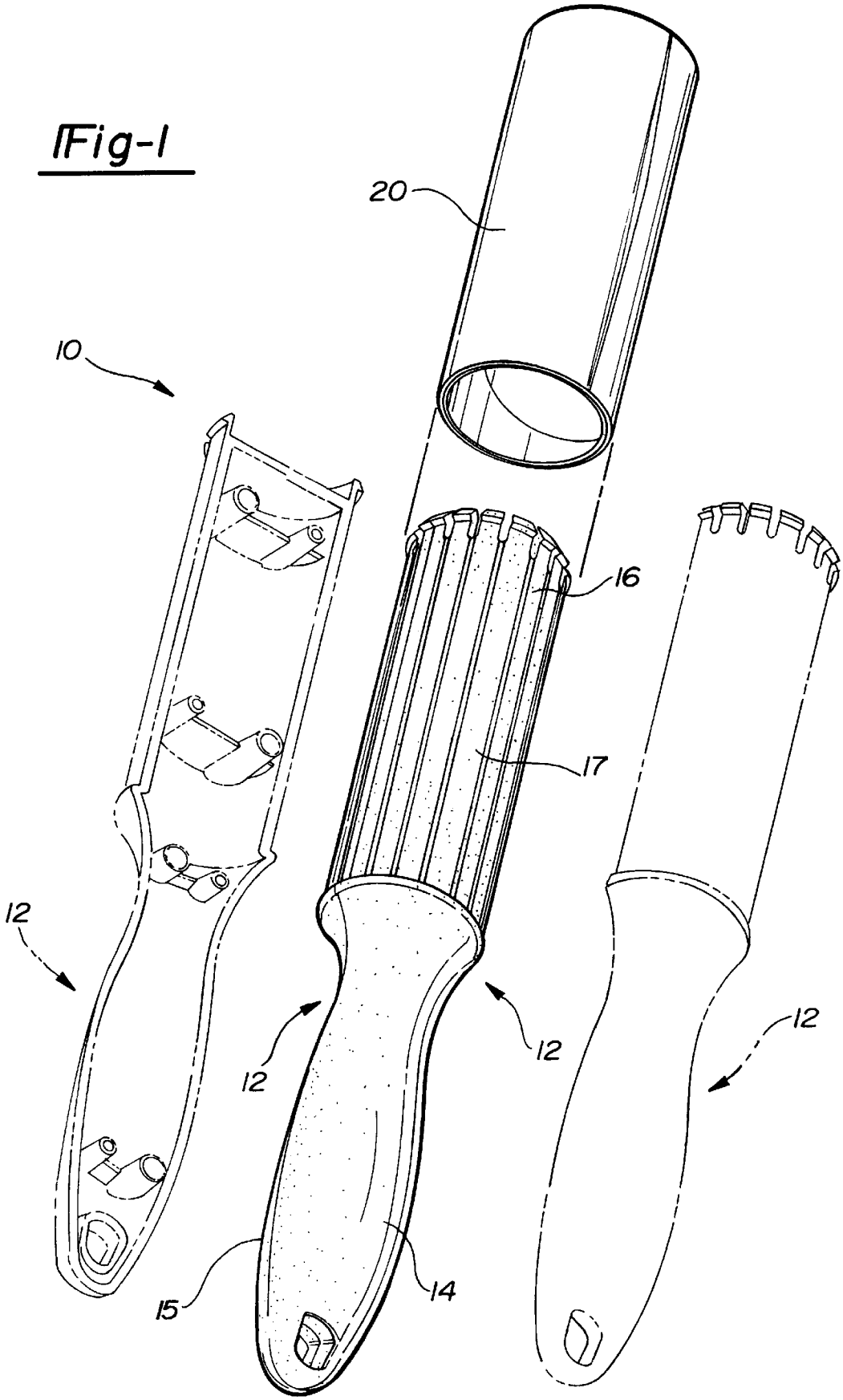
FIG. 1 is an elevational exploded view illustrating a preferred embodiment of the present invention.

With reference first to FIG. 1, the preferred embodiment of the lint roller assembly 10 of the present invention is thereshown and comprises a pair of housing parts 12 which are substantially identical to each other. Each housing part 12, furthermore, includes an elongated handle section 14 and a longitudinally adjacent lint roller support section 16. The lint roller support section 16, furthermore, is generally semi-cylindrical in shape.

With the housing parts 1:2 secured together in facing relationship as illustrated in FIG. 1, the handle sections 14 abut together to form a handle 15 and, similarly, the semi-cylindrical lint roller support section 16 abut together to form a cylindrical lint roller support 17 having a predetermined outside diameter. A tubular and cylindrical adhesive lint roller 20 is then inserted over and rotatably supported by the lint roller support 17 in a fashion to be subsequently described in greater detail. However, the lint roller 20 has an inside diameter greater than the outside diameter of the lint roller support 17 to permit free rotation of the lint roller 20 relative to the support 17.

Figure 2:
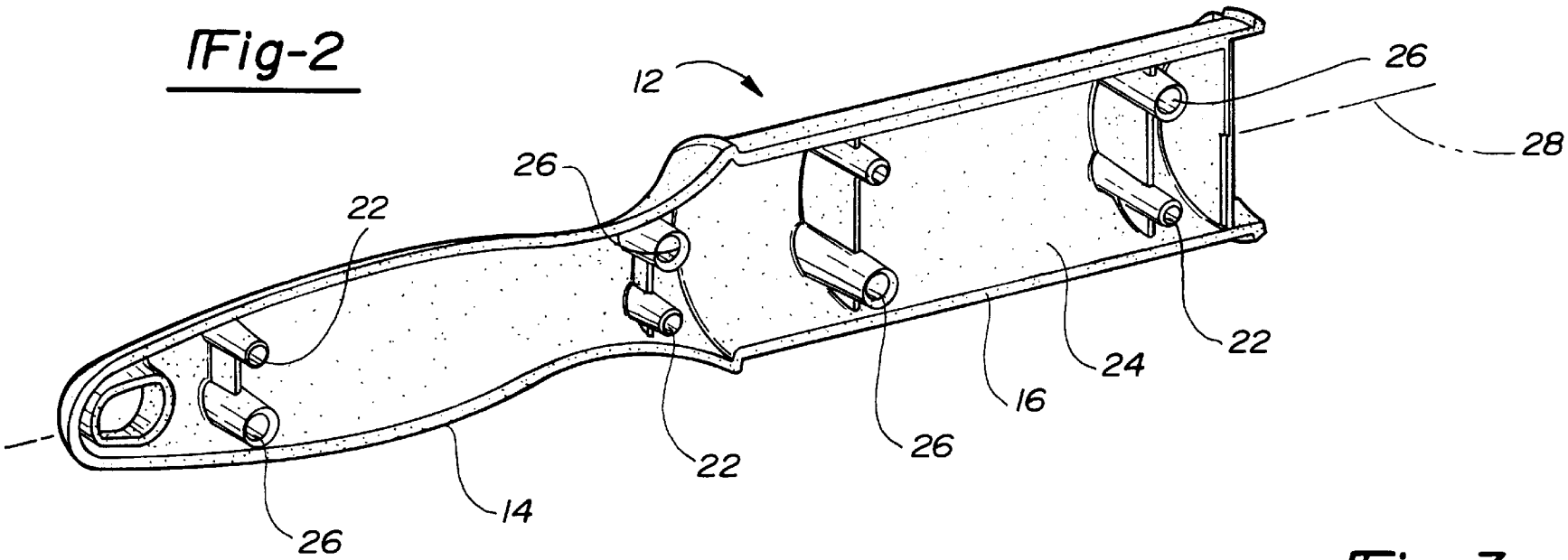
FIG. 2 is an elevational view illustrating an inside of one housing part.
Figure 4:
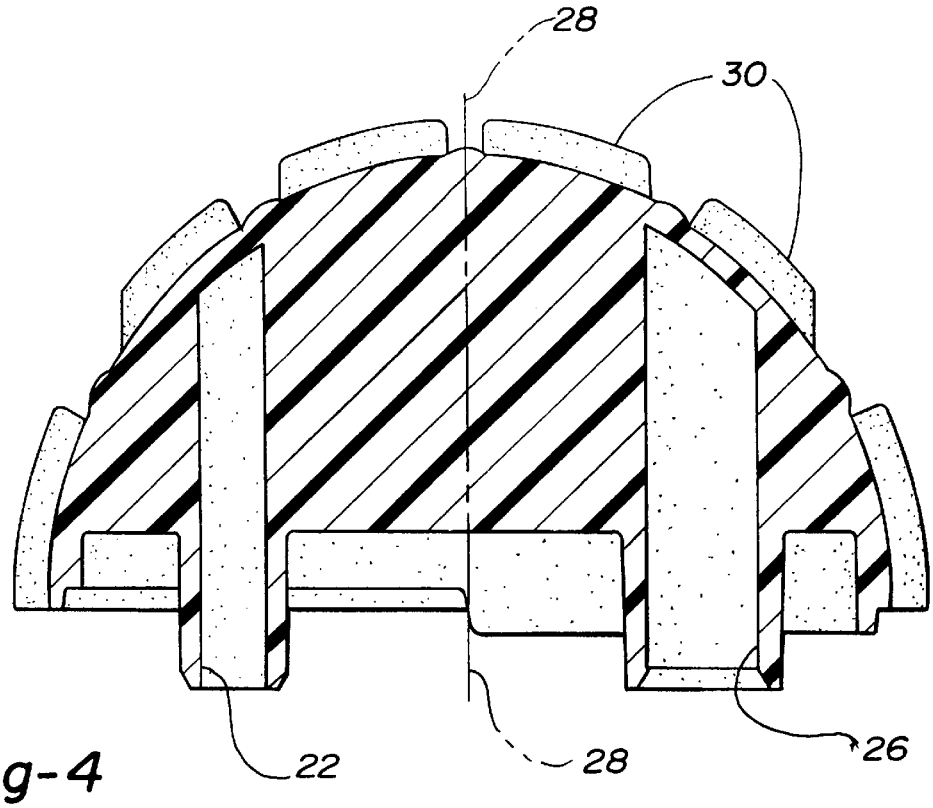
FIG. 4 is a sectional view taken substantially along line 4—4 in FIG. 2 and enlarged for clarity.

With reference now to FIGS. 2 and 4, in order to secure the housing parts 12 together, the housing part 12 includes at least one pin 22, and preferably several longitudinally spaced pins 22, protruding outwardly from an inside surface 24 of the housing part 12. A corresponding, recess 26 is provided for each pin 22 such that the recess 26 is both laterally aligned and parallel to its corresponding pin 22. Furthermore, as best shown in FIG. 4, each pin 22 and recess 26 pair is laterally equidistantly spaced from a longitudinal center line of the lint roller support section 16. Consequently, when the housing parts 12 are in a facing relationship (FIG. 1) such that each pin 22 registers with its corresponding recess 26, the outer edges of the lint roller support section 16 meet each other in flush engagement.

In the preferred embodiment of the invention, both the pins 22 and recesses 26 are circular in cross-sectional shape although other shapes may alternatively be used. Furthermore, the outer diameter of the pin 22 is substantially the same, or slightly greater than, the inside diameter of its corresponding recess 26 so that, with the housing parts 12 pressed together, the frictional engagement between the pins 22 and their corresponding recesses 26 frictionally lock the housing parts 12 together. Optionally, an adhesive can be used between the pins 22 and recesses 26.

Figure 3:
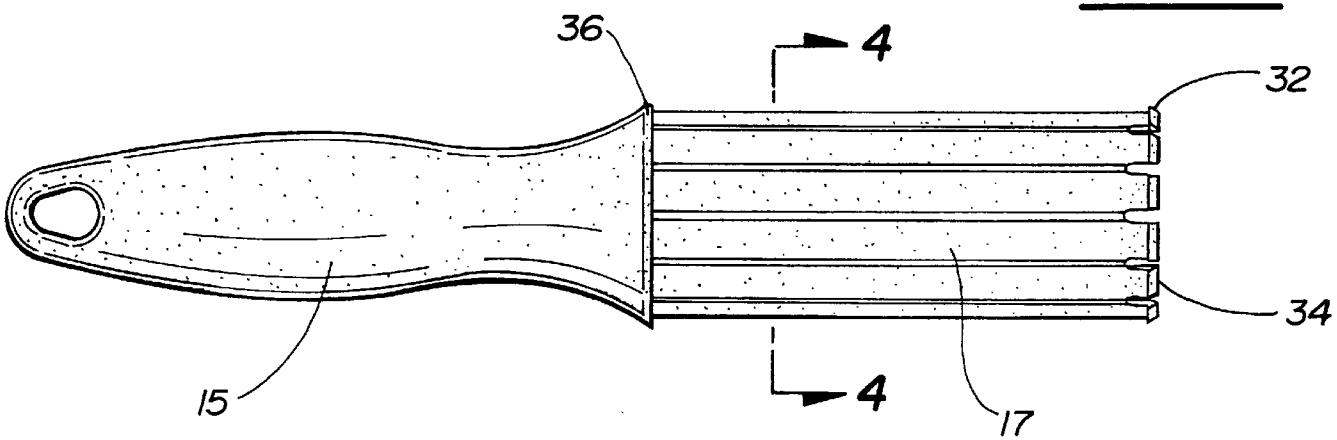
FIG. 3 is an elevational view similar to FIG. 2, but illustrating the outer side of the housing part.

With reference now to FIGS. 3 and 4, a plurality of circumferentially spaced and longitudinally extending ribs 30 are formed along the outer surface of the lint roller support 17. These ribs 34 operate not only to mechanically strengthen the lint roller support 17, but also to minimize the frictional engagement between the outer periphery of the lint roller support 17 and the inner periphery of the lint roller 20.

Figure 5:
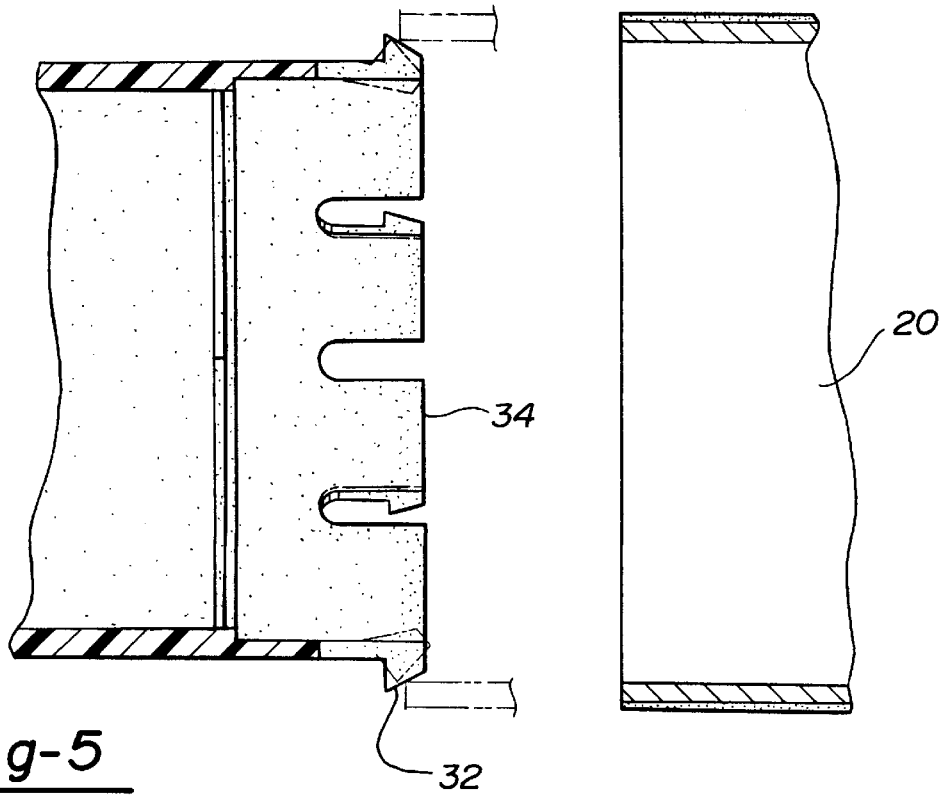
FIG. 5 is a fragmentary diagrammatic view illustrating one portion of the preferred embodiment of the invention.

With reference now to FIG. 5, a plurality of circumferentially spaced and radially outwardly extending flexible fingers 32 are formed around an end 34 of the lint roller support 17 most distant from the handle 15. In their unflexed state, the outer diameter of these fingers 32 is greater than the inside diameter of the lint roller 20. However, by flexing inwardly, the fingers 32 permit the lint roller 20 to be inserted over the end 34 and onto the lint roller support 17. A radially outwardly extending flange 36 at the junction between the handle 15 and lint roller support 17 has a diameter greater than the inside diameter of the lint roller 20 such that the lint roller 20 is longitudinally trapped on the lint roller support 17 between the flange 36 and the fingers 32.

From the foregoing, it can be seen that the lint roller assembly of the present invention provides an economical yet durable lint roller assembly. Furthermore, since the housing parts are substantially identical to each other, only a single mold cavity design is required to form the entire lint roller handle and support.

Having described my invention, however, many modifications thereto will become apparent to those skilled in the art without deviation from the spirit of the invention as defined by the scope of the appended claims.

I claim:

1. A lint roller assembly comprising:

a tubular and cylindrical adhesive lint roller, a pair of elongated housing parts, each housing part being substantially identical to the other, each housing part having an elongated handle section and a semicylindrical lint roller support section longitudinally adjacent the handle section, said semicylindrical lint roller support section having an outer diameter less than the diameter of the roller, means for securing said housing parts together in facing relationship such that said semicylindrical lint roller support sections together form a cylindrical lint roller support and said handle sections abut against each other to form a handle.

2. The invention as defined in claim 1 wherein each housing part is of a one piece construction.

3. The invention as defined in claim 2 wherein each said housing part is made of a plastic material.

4. The invention as defined in claim 1 wherein each semicylindrical support section includes a plurality of circumferentially spaced and radially outwardly extending flexible fingers around its end most distant from its associated handle section, said fingers having an outer diameter greater than an inner diameter of the roller.

5. The invention as defined in claim 1 wherein each lint roller support section includes a plurality of axially extending and circumferentially spaced ribs along its outer periphery.

6. The invention as defined in claim 1 wherein each housing part is of a one piece molded plastic construction.

7. The invention as defined in claim 6 wherein said handle sections and said support sections are coaxially aligned.

8. The invention as defined in claim 1 wherein said securing means comprises at least one pin and one recess, said pin and said recess being formed on opposite sides of and equidistantly spaced from a longitudinal centerline of each said housing part, said recess dimensioned to receive said pin, and said pin and said recess being laterally aligned with each other.

9. The invention as defined in claim 8 and comprising a plurality of longitudinally spaced complementary pins and recesses.

10. The invention as defined in claim 8 wherein said recess is dimensioned to frictionally engage said pin upon insertion.

11. The invention as defined in claim 10 wherein said pin and said recess are circular in cross-sectional shape.

* * * * *